US010261453B2

(12) United States Patent
Tomihisa

(10) Patent No.: US 10,261,453 B2
(45) Date of Patent: Apr. 16, 2019

(54) PRINTING SYSTEM AND PRINTING METHOD FOR PRINT JOB

(71) Applicant: CANON KABUSHIKI KAISHA, Tokyo (JP)

(72) Inventor: Taishi Tomihisa, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/709,689

(22) Filed: Sep. 20, 2017

(65) Prior Publication Data

US 2018/0088505 A1 Mar. 29, 2018

(30) Foreign Application Priority Data

Sep. 26, 2016 (JP) ..... 2016-187477

(51) Int. Cl.
*G03G 15/00* (2006.01)

(52) U.S. Cl.
CPC ..... *G03G 15/5008* (2013.01); *G03G 15/502* (2013.01); *G03G 2215/00949* (2013.01)

(58) Field of Classification Search
CPC .. G03G 15/502; G03G 15/50; G03G 15/5087; G03G 15/5083
See application file for complete search history.

(56) References Cited

U.S. PATENT DOCUMENTS 8,760,713 B2 * 6/2014 Zhan ..... G03G 15/5004 358/1.13
2006/0110171 A1 * 5/2006 Miyazawa ..... H04N 1/00209 399/8
2007/0144367 A1 * 6/2007 Mori ..... B41L 13/06 101/117
2014/0320902 A1 * 10/2014 Nakatani ..... G03G 15/502 358/1.15

FOREIGN PATENT DOCUMENTS

JP 2005-085031 A 3/2005

* cited by examiner

*Primary Examiner* — Walter L Lindsay, Jr.
*Assistant Examiner* — Jessica L Eley
(74) *Attorney, Agent, or Firm* — Venable LLP

(57) ABSTRACT

A printing system that includes a print unit capable of printing at a first printing speed and a second printing speed that is faster than the first printing speed includes a storage unit that stores a number of sheets for which the printing can be executed at the second printing speed, and a display unit that displays a screen for designation of the second printing speed by a user, and that displays a remaining number of sheets for which the printing can be executed at the second printing speed, based on the number of sheets stored in the storage unit. Based on the designation, the print unit can execute the printing for the print job at the second printing speed, and an update unit updates the stored number of sheets by reducing the number of sheets stored by a number of sheets used for the printing at the second printing speed.

18 Claims, 10 Drawing Sheets

PRINTING SYSTEM AND PRINTING METHOD FOR PRINT JOB

This application claims the benefit of Japanese Patent Application No. 2016-187477, filed Sep. 26, 2016, which is hereby incorporated by reference herein in its entirety.

BACKGROUND OF THE INVENTION

Field of the Invention

The present invention relates to a printing system and a printing method for a print job.

Description of the Related Art

Conventionally, a technique has been disclosed in which, in an image forming apparatus that prints print data, a printing speed of the image forming apparatus is changed within a range so as not to exceed basic capabilities and a charge amount required for printing is changed in accordance with the changed printing speed (Japanese Patent Laid-Open No. 2005-85031).

For example, user requirements differ for each situation when executing a print job, such as a situation in which one does not mind paying an additional charge to get a print material quickly in order to be on time, and a situation in which one does not mind if the print material is printed at a normal printing speed. It was impossible, however, for a user to determine whether user requirements are satisfied or to decide the printing speed appropriately at the time of print job execution.

SUMMARY OF THE INVENTION

An aspect of the present invention is to eliminate the above-mentioned problems with the conventional technology. The present invention provides a printing system that appropriately sets a printing speed for a print job, and a printing method.

In one aspect of the present invention, a printing system includes a print unit that executes printing for a print job according to a print instruction received from a user. The printing system also includes a determination unit that determines whether or not selecting a printing speed from among a plurality of candidates of printing speeds for the print job is permitted, a display unit that displays, based on the determination, the plurality of candidates for the print job so as to be selectable by the user, and a control unit that controls the print unit to execute, based on the selection by the user, the printing for the print job at a printing speed selected from the displayed plurality of printing speed candidates.

According to the present invention, the user can appropriately set a printing speed for a print job.

Further features of the present invention will become apparent from the following description of exemplary embodiments with reference to the attached drawings.

DESCRIPTION OF THE EMBODIMENTS

Embodiments of the present invention will be described in detail, with reference to the accompanying drawings. The following embodiments are not intended to limit the claims of the present invention, and not all of the combinations of the aspects that are described according to the following embodiments are necessarily required with respect to the means to solve the problems according to the present invention.

First Embodiment

Figure 1:
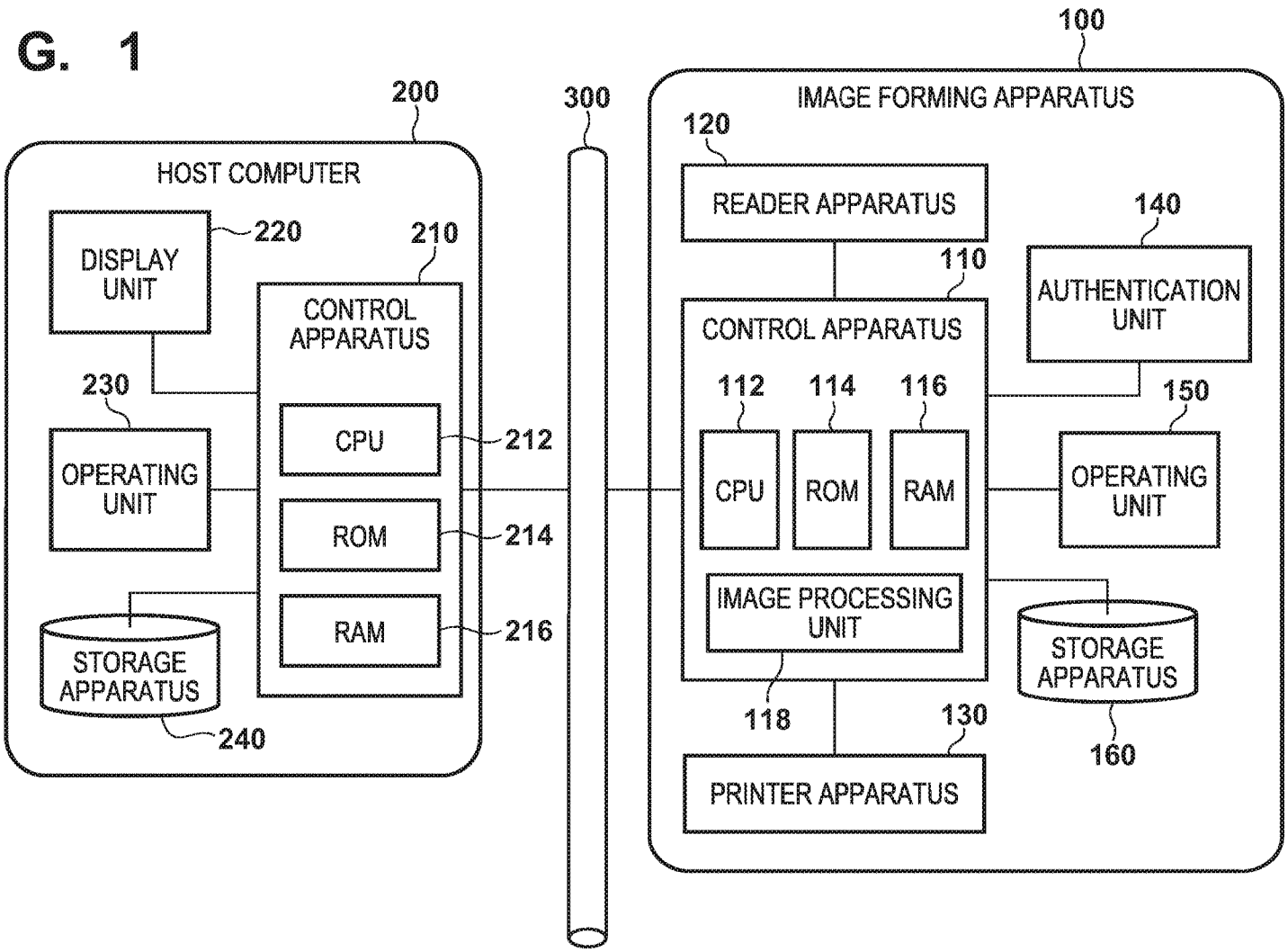
FIG. 1 is a block diagram illustrating a configuration of a print system.

FIG. 1 is a block diagram illustrating a configuration of a print system in a first embodiment. An image forming apparatus 100 and a host computer 200 are connected so as to be able to communicate with each other via a network 300 that may be Ethernet or the like. The host computer 200 is an apparatus that generates jobs and data to be printed, for example, and the image forming apparatus 100 is an apparatus that prints an image on a print medium based on a job and the data to be printed that are transmitted from the host computer 200, for example. In the present embodiment, an MFP (Multi Function Printer), for example, is used as the image forming apparatus 100. The image forming apparatus 100 is an apparatus that prints an image on a print medium, and it is not particularly limited to an MFP. For example, an apparatus having a printer function of another print method, such as an SFP (Single Function Printer) and an LBP (Laser Beam Printer), may be used as the image forming apparatus 100.

The image forming apparatus 100 includes a reader apparatus 120, a printer apparatus 130, an operating unit 150, a storage apparatus 160, an authentication unit 140, and a control apparatus 110 that controls each of these configuration elements. The control apparatus 110 includes a CPU 112, a ROM 114, a RAM 116, and an image processing unit 118. The CPU 112 comprehensively controls the image forming apparatus 100 as a whole by reading a program stored in the ROM 114, or another storage medium, into the RAM 116, and then executing the program. For example, the processes of each later-described flowchart of the image forming apparatus 100 are executed based on programs stored in the ROM 114 or another storage medium. The RAM 116 is used as a work area of the CPU 112. The image processing unit 118 executes various image processing, such as correction processing and conversion processing for converting data obtained by the reader apparatus 120 reading an original, or data to be printed into a data format that can be processed in the printer apparatus 130.

In the reader apparatus 120, according to an instruction from the control apparatus 110, an original set on an original platen (not shown) is optically read. In the printer apparatus 130, upon an instruction from the control apparatus 110, printing of an image onto a print medium is performed by a printer engine corresponding to a respective print method, such as an ink-jet printing method or an electrophotographic method. The operating unit 150 comprises a liquid crystal panel (a touch panel) that performs display/setting reception for operation keys for receiving instructions to execute a function of the image forming apparatus 100 and setting operations from a user, and various user interface screens, such as for designation of data to be printed. The operating unit 150 notifies received operation information to the control apparatus 110.

The storage apparatus 160 stores print data, setting data, authentication information (authentication information used for verification against later-described user authentication information) used in the authentication unit 140. Note that a job for printing an image based on print data is called a print job, and printing such an image is called executing a print job. There are cases in which the storage apparatus 160 is used as a work area of the CPU 112. Unit price information for a print sheet (hereinafter referred to as a sheet) contained in a tray of the image forming apparatus 100, and license information corresponding to a user/group is stored in the storage apparatus 160. In the present embodiment, the license information is a number of sheets that can be printed at high speed that is assigned to a user or a group, for example. Output is concentrated in a particular time band on Monday, for example. High speed printing is print processing control for accelerating printing apparatus output for such a time band. Other than respective time bands, there are embodiments in which output is accelerated in a unit of a job, a group, such as a department, or a user. The amount of high speed printing that is possible for each unit is managed by an administrator as a number of sheets or a money amount, for example. There are a variety of techniques to accelerate a printing speed of the image forming apparatus 100. When the high speed printing is performed on sheets whose sizes and types are the same, the image forming apparatus 100 may shorten the interval between the sheets fed from the tray, for example. In other words, the sheet feeding interval is shortened. Specifically, the image forming apparatus 100 may feed, print, and discharge the sheets whose interval is a first predetermined distance (or time) when the image forming apparatus 100 prints the sheets at the normal printing speed, and may feed, print, and discharge the sheets whose interval is a second predetermined distance (or time) shorter than the first predetermined distance (or time) when the image forming apparatus 100 prints the sheets at a high printing speed. In another example, when the high speed printing is performed on the sheets, the image forming apparatus 100 may accelerate a process speed of the image forming apparatus 100 (e.g. rotational speeds of a photosensitive drum, a sheet feeding roller, and a sheet discharge roller, and a sheet conveying speed of a sheet conveyance belt of the image forming apparatus 100). Of course, other techniques to accelerate the printing speed may be applied to the image forming apparatus 100.

The authentication unit 140 obtains user authentication information of an ID card or the like, and notifies it to the control apparatus 110. The user authentication information may be received via operation keys of the operating unit 150, for example, or may be obtained from an ID card brought into the proximity of the image forming apparatus 100.

The host computer 200 includes an operating unit 230, a storage apparatus 240, a display unit 220, and a control apparatus 210 that controls each of these configuration elements. The control apparatus 210 includes a CPU 212, a ROM 214, and a RAM 216. The CPU 212 comprehensively controls the host computer 200 as a whole based on an operating system program (OS) that is a control program stored in the ROM 214 or another storage medium. For example, the processes of each later-described flowchart of the host computer 200 are executed based on programs stored in the ROM 214 or another storage medium. Note that the RAM 216 is used as a work area of the CPU 212.

The operating unit 230 comprises a keyboard and a pointing device for receiving operations from a user, and notifies received operation information to the control apparatus 210. The storage apparatus 240 stores setting information and data to be printed that is generated using an application. Unit price information for a sheet is contained in a tray of the image forming apparatus 100, and license information corresponding to a user/group is stored in the storage apparatus 240. Also, there are cases in which the storage apparatus 240 is used as a work area of the CPU 212. The display unit 220 comprises a liquid crystal display or the like, and displays the results of execution of programs by the CPU 212 and various user interface screens.

It was mentioned above that both the host computer 200 and the image forming apparatus 100 hold unit price information for sheets contained in a tray of the image forming apparatus 100 and license information corresponding to users/groups. The host computer 200 may, however, obtain this information as needed from the image forming apparatus 100. Also, a management apparatus (server) that stores and manages sheet unit price information and license information may be configured separately from the host computer 200 and the image forming apparatus 100, and the host computer 200 and the image forming apparatus 100 may obtain this information as needed from the management apparatus.

Figure 2:
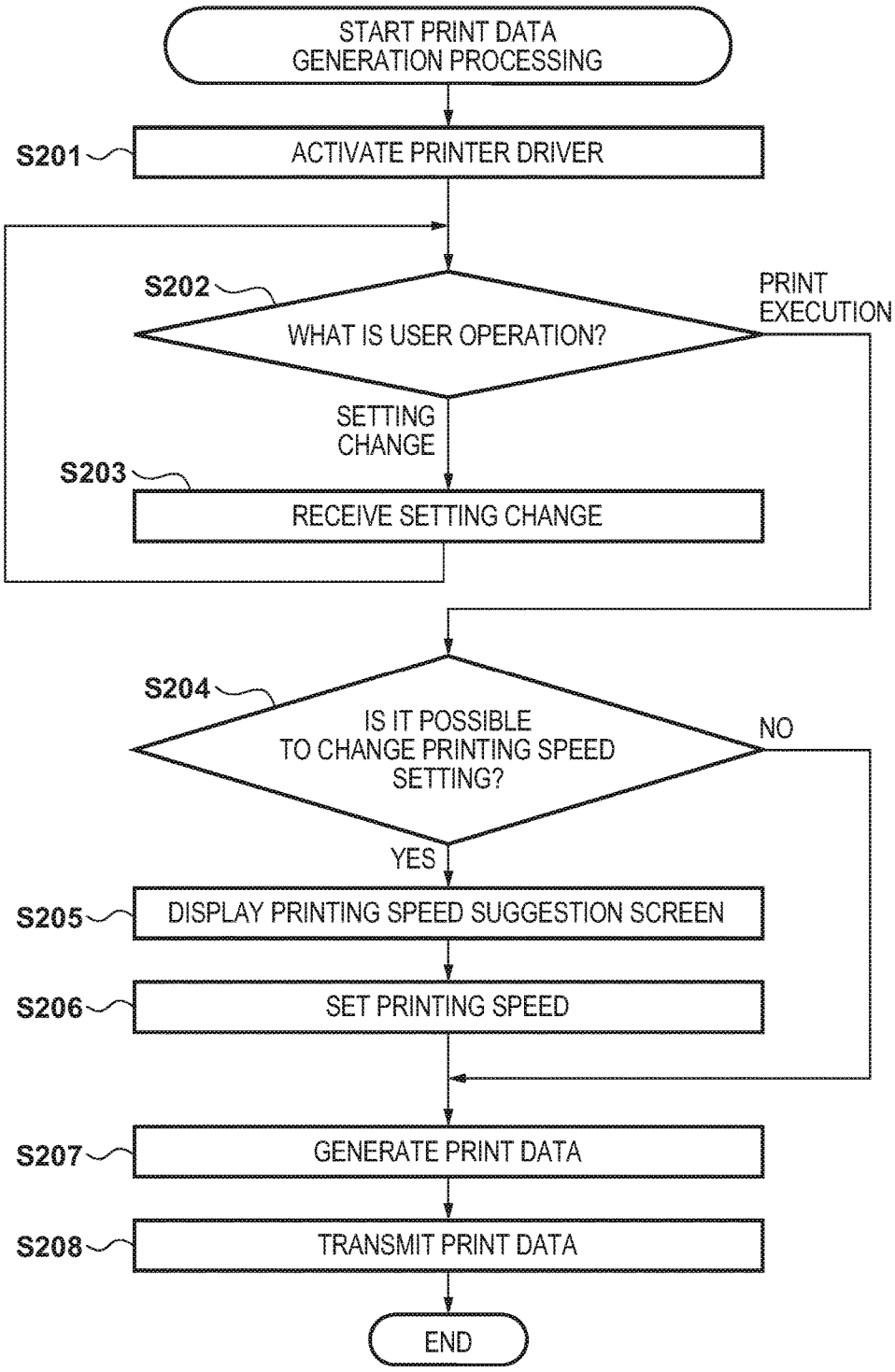
FIG. 2 is a flowchart for describing a print data generation process of a host computer.

FIG. 2 is a flowchart that illustrates print data generation processing of the host computer 200 in the present embodiment. The process illustrated in FIG. 2 is realized by the CPU 212 reading a program stored in the ROM 214 into the RAM 216 and executing the program, for example.

In step S201, the CPU 212 receives a print instruction from a user via an application, and activates a printer driver. In step S202, the CPU 212 displays the printer driver user interface (UI) on the display unit 220. Then, the CPU 212 receives a selection operation from the user as to whether to perform a setting change, such as a print setting or an image processing setting, or to execute printing without performing a setting change. In a case in which a selection to perform a setting change is received, the processing proceeds to step S203, and in a case in which a selection to execute printing is received, the processing proceeds to step S204. In step S203, the CPU 212 receives a setting change operation for a print setting or an image processing setting or the like from a user via the operating unit 230. After step S203, the processing of step S202 is repeated.

In step S204, the CPU 212 determines whether or not it is possible to change the printing speed setting. Here, it is determined whether or not it is possible to change a normal printing speed setting to a higher printing speed. For example, the CPU 212 obtains a number of sheets that can be printed at high speed that is assigned to a user by querying the image forming apparatus 100, and in a case in which all of the pages of the print job to be executed can be printed at high speed, it determines that the printing speed setting can be changed. In addition, the CPU 212 may determine whether or not it is possible to change a printing speed setting in accordance with a paper size and a paper type designated by a print setting. In the case in which, in step S204, it is determined that the printing speed setting can be changed, the processing proceeds to step S205, and in the case in which it is determined that the printing speed setting cannot be changed, the processing proceeds to step S207.

Figure 7:
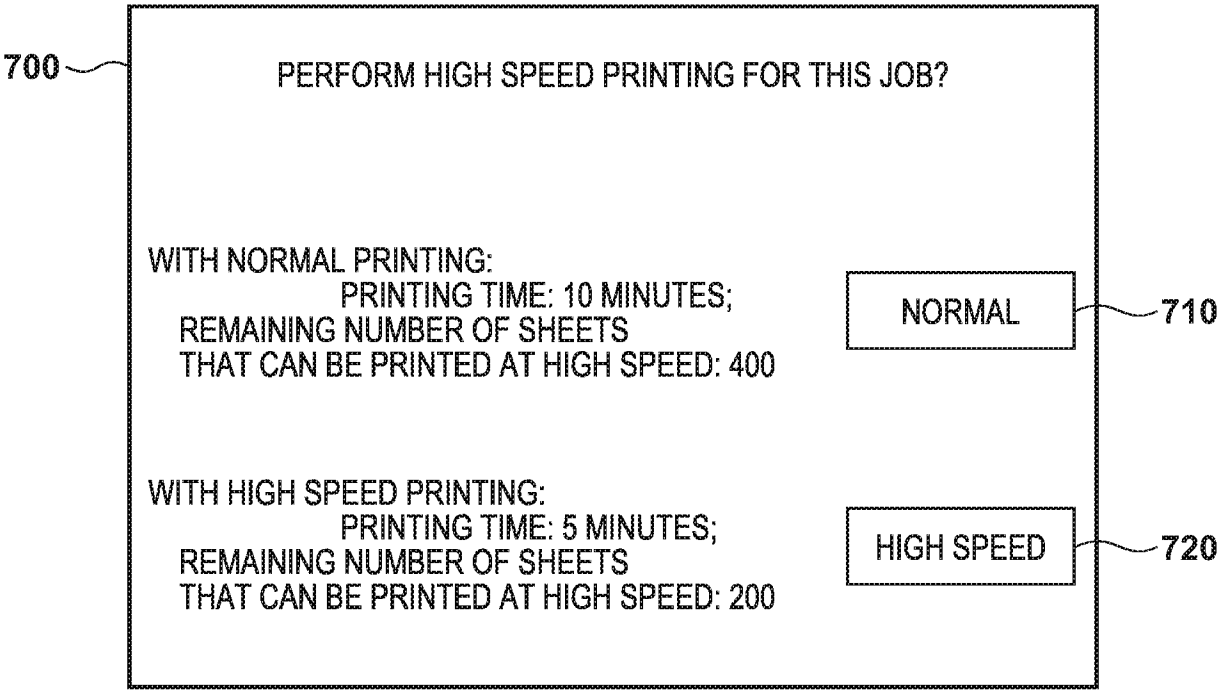
FIG. 7 is a view illustrating a printing speed suggestion screen.

In step S205, the CPU 212 displays the printing speed suggestion screen to the display unit 220. FIG. 7 is a view illustrating an example of a printing speed suggestion screen 700 for a particular print job. On the printing speed suggestion screen 700, a plurality of printing speed candidates that can be executed in the printing are displayed so as to be selectable. Also, on the printing speed suggestion screen 700, a time required for print processing at each printing speed, and a number of sheets that can be printed at high speed that will remain after print execution are displayed. For example, in FIG. 7, when printing is executed at the normal printing speed, the print time is 10 minutes, and it is indicated that the number of sheets that the user can print at high speed that will remain after print execution is 400. Also, when printing is executed at a high printing speed, it is indicated the print time will be 5 minutes, and that the number of sheets that the user can print at high speed that will remain after print execution is 200. In the present embodiment, the required amount (required time, required number of sheets, or the like) accompanying a print operation at each printing speed is displayed by the printing speed suggestion screen 700 illustrated in FIG. 7. The result of this is that the user can determine at which printing speed (normal or high speed) to execute printing considering a prediction value that the print time will be shortened by 5 minutes and the number of sheets that can be printed at high speed will be reduced by 200, for example.

The determination as to whether or not the setting of the printing speed in step S204 can be changed may be performed based on cost-effectiveness, for example. For example, a configuration may also be taken such that from the shortened print time in the case of executing printing at the high printing speed and the money amount conversion value for the number of sheets used in the high speed printing, a shortened time per unit money amount is calculated, and if it is less than or equal to a threshold, it is determined that the printing speed setting cannot be changed. In the example described in FIG. 7, in the case in which the print job is executed at a high printing speed, the print shortening time is 5 minutes, and the number of sheets that can be printed at high speed becomes 200. Here, assuming that the unit price for a sheet for high speed printing is 0.6 yen, for example, the money amount conversion value is 120 yen, and the shortened time per unit money amount is 2.5 seconds/yen. As cost-effectiveness is high if this value is greater than or equal to the threshold, it may be determined in step S204 that it is possible to change the printing speed setting. Also, as cost-effectiveness is low if this value is smaller than the threshold, it may be determined in step S204 that it is not possible to change the printing speed setting, and, therefore, the CPU 212 will not display the screen of FIG. 7.

In step S206, the CPU 212 sets the printing speed based on selection operation information received via the operating unit 230. In a case in which a press of a normal print execution button 710 is received from the user, the CPU 212 sets the normal printing speed, for example, to 40 PPM (pages/minute) as the printing speed for this printing operation. Also, in a case in which a press of a high speed print execution button 720 is received from the user, the CPU 212 sets a high printing speed, for example, at 60 PPM, as the printing speed for this print operation.

In step S207, the CPU 212 receives a print instruction that is notified via the OS from the application, and generates data (print data) to be printed in accordance with various settings. If a setting change is received in step S203, the contents thereof are reflected. The CPU 212 adds print speed information set in step S206 to the generated print data. The print speed information may be, for example, a rotation speed or a paper size of a photosensitive drum used in the electrophotographic method. In step S208, the CPU 212 transmits the print data to the image forming apparatus 100 via the network 300, and finishes the processing of FIG. 2. In step S208, other than the print data and the print job, the foregoing print speed information is also transmitted. As described above, the CPU 212 associates the printing speed with the print data, and transmits the print data to the image forming apparatus 100. By associating the print job and the printing speed in this way, it becomes possible to execute the print job at the associated printing speed. Also, by this association, even if the user inputs a plurality of print jobs into the image forming apparatus 100, the user can execute each of the print jobs at the printing speeds designated for the respective print jobs. Also, it is possible to designate a printing speed of a target print job independently to a printing speed that another user designated and a printing speed of a currently executing print job.

Figure 3:
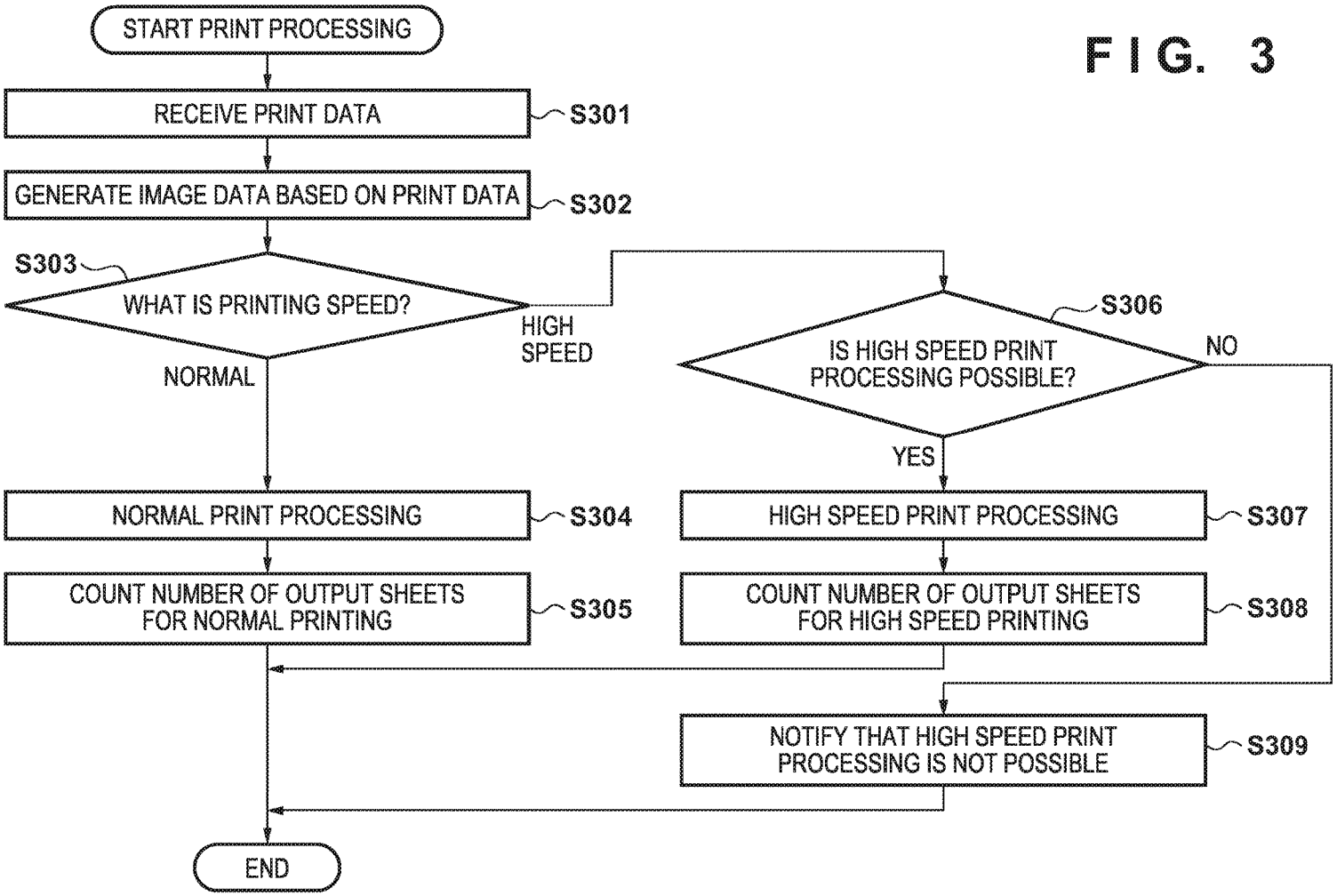
FIG. 3 is a flowchart for describing a printing process of an image forming apparatus.

FIG. 3 is a flowchart illustrating print control processing of the image forming apparatus 100 in the present embodiment. The process illustrated in FIG. 3 is realized by the CPU 112 reading a program stored in the ROM 114 into the RAM 116 and executing the program, for example.

In step S301, the CPU 112 receives print data transmitted from the host computer 200 in step S208 of FIG. 2. In step S302, the CPU 112 interprets the received print data, and generates image data that can be processed in the printer apparatus 130. At that time, the CPU 112 obtains print speed information added in the host computer 200. Here, in the case in which print speed information is not added to the print data, it is determined that the normal printing speed is set, and processing thereafter is performed.

In step S303, the CPU 112 determines whether the obtained print speed information indicates the normal printing speed or indicates the high printing speed, and switches the print processing thereafter. In the case in which it is determined that the normal printing speed is indicated, the processing proceeds to step S304, and in the case in which it is determined that the high printing speed is indicated, the processing proceeds to step S306.

In step S304, the CPU 112 transfers the print speed information indicating the normal printing speed and the image data generated in step S302 to the printer apparatus 130. The printer apparatus 130 performs a printing process on a sheet based on the received image data at the normal printing speed. In step S305, the CPU 112 increases a counter for normal printing allocated in the RAM 116 or the like by the number of output sheets, and thereafter, the processing of FIG. 3 finishes.

Meanwhile, in step S306, the CPU 112 determines whether or not high speed print processing is possible based on rendering process (rendering processing) information corresponding to the image data generated in step S302. For example, when image data having a lot of gradation and thin lines makes high resolution processing necessary, there are cases in which the rendering speed cannot keep up with the high printing speed (for example, the rotation speed of the photosensitive drum) that is set. In such a case, it is determined that high speed print processing is not possible, and in step S309, the CPU 112 notifies to the host computer 200 that the high speed print processing is not possible. After that, the processing of FIG. 3 finishes. Meanwhile, in a case in which it is determined that the high speed print processing is possible, the processing proceeds to step S307. The host computer 200, after receiving the notification from the image forming apparatus 100 in step S309, displays a warning screen that indicates that high speed print processing is not possible on the display unit 220. The warning screen may be configured to be able to receive an instruction to execute printing at the normal printing speed.

In step S307, the CPU 112 transfers the print speed information indicating the high printing speed and the image data generated in step S302 to the printer apparatus 130. The printer apparatus 130 performs a printing process on a sheet based on the received image data at the high printing speed. In step S308, the CPU 112 increases a counter for high speed printing allocated in the RAM 116 or the like by the number of output sheets. Then, the CPU 112 updates the number of sheets that can be printed at high speed that is stored in the storage apparatus 160 and assigned to the user so as to reduce the number of sheets that can be printed at high speed by the number of output sheets. After that, the processing of FIG. 3 finishes.

In the present embodiment, in step S205, the remaining number of sheets that can be printed at high speed is displayed as determination criteria information for the user. A configuration may also be taken, however, such that, in the case in which an amount of deposited money (license) from the user is insufficient to perform high speed printing, for example, information of a necessary additional money amount is displayed. Also, in such a case, after step S202, a configuration may also be taken such that the processing of step S205 is performed without performing the determination processing of step S204.

As described above, by virtue of the present embodiment, a user can appropriately set a printing speed of a print job in accordance with a situation at the time of executing the print job. Also, it is possible to provide information for the user to appropriately determine the printing speed in accordance with the situation for each piece of print data. As a result, it is possible for the user to appropriately decide the printing speed while considering the effect of printing at each printing speed.

Second Embodiment

In the first embodiment, a configuration in which the image forming apparatus 100 receives print data from the host computer 200, and performs printing in accordance with the printing speed selected by the user was described. In the second embodiment, when the image forming apparatus 100 receives print data from the host computer 200, the image forming apparatus 100 first stores the received print data to the storage apparatus 160. Then, a job list corresponding to a user that logged in to the image forming apparatus 100 is displayed on the operating unit 150, and a job selection, a printing speed selection, or an instruction to execute print processing is received. That is, in the second embodiment, in so-called retention printing, a setting of the printing speed that the user selected is performed. Hereinafter, description is given regarding points that are different than the first embodiment in the second embodiment.

Figure 4:
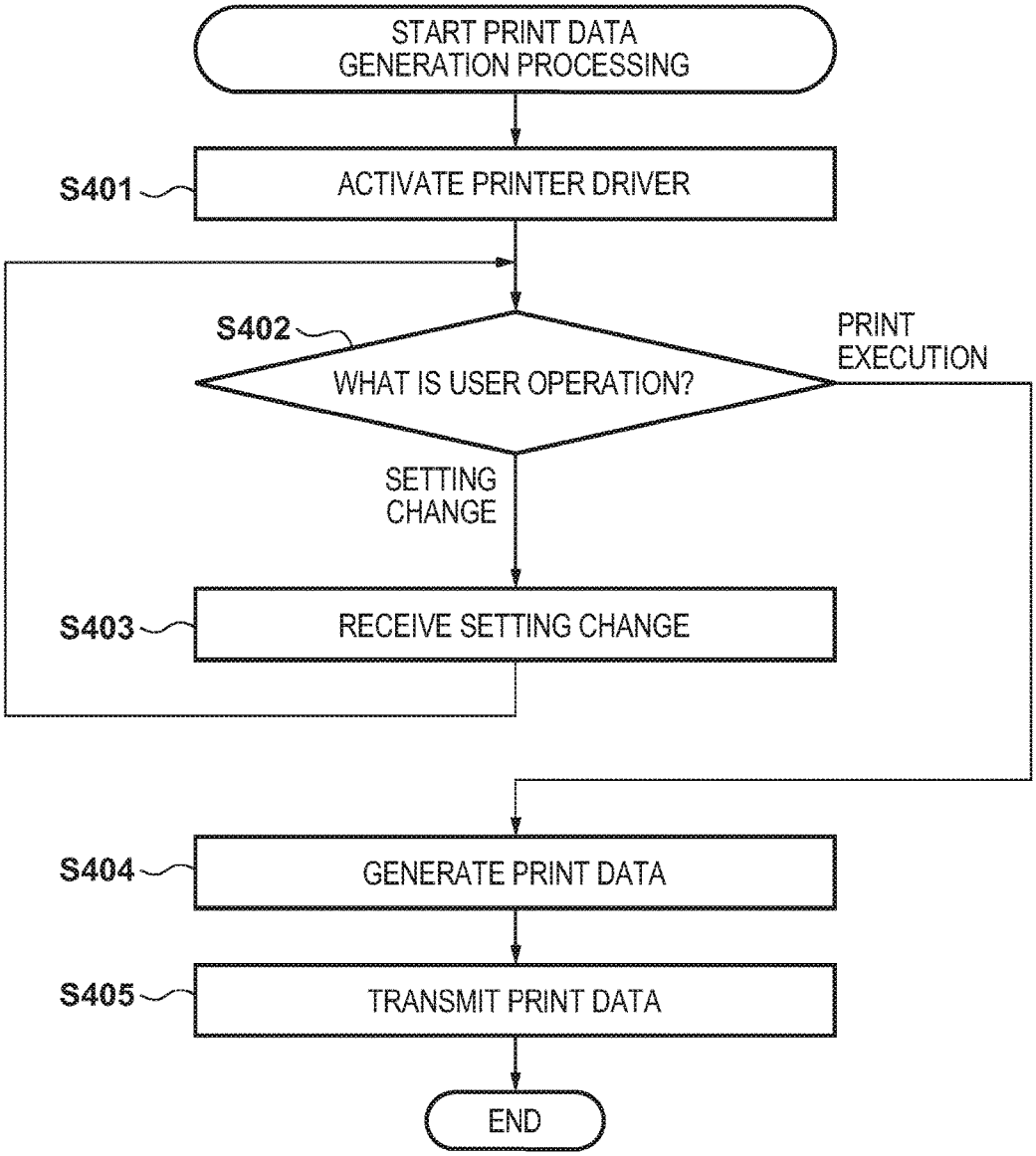
FIG. 4 is a flowchart for describing a print data generation process of the host computer.

FIG. 4 is a flowchart that illustrates print data generation processing of the host computer 200 in the second embodiment. The process illustrated in FIG. 4 is realized by the CPU 212 reading a program stored in the ROM 214 into the RAM 216 and executing the program, for example.

In step S401, the CPU 212 receives a print instruction from a user via an application, and activates a printer driver. In step S402, the CPU 212 displays a printer driver UI on the display unit 220, and receives a selection operation from the user as to whether to perform a setting change for a print setting or an image processing setting or the like, or to execute printing without performing a setting change. In a case in which a selection to perform a setting change is received, the processing proceeds to step S403, and in a case in which a selection to execute printing is received, the processing proceeds to step S404. In step S403, the CPU 212 receives a setting change operation for a print setting or an image processing setting or the like from a user via the operating unit 230. After step S403, the processing of step S402 is repeated.

In step S404, the CPU 212 receives a print instruction that is notified via the OS from the application, and generates print data in accordance with various settings. If a setting change is received in step S403, the contents thereof are reflected. The CPU 212 adds user information for identifying the user to the generated print data. In step S405, the CPU 212 transmits the print data to the image forming apparatus 100 via the network 300, and finishes the processing of FIG. 4.

Figure 5:
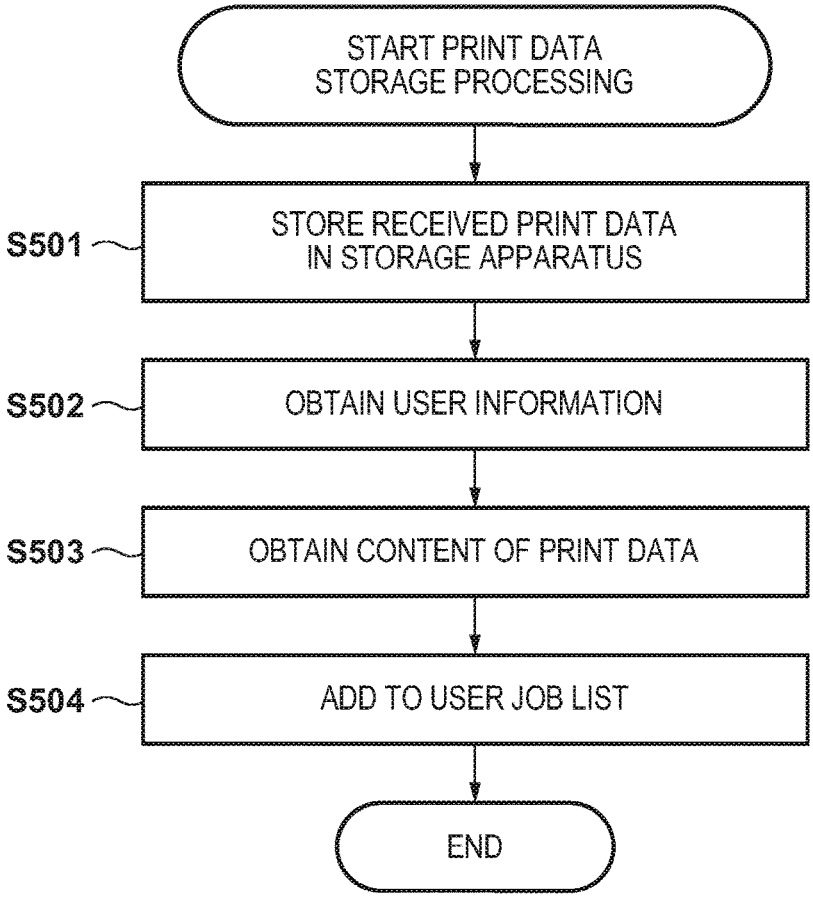
FIG. 5 is a flowchart for describing a print data storage process of the image forming apparatus.

FIG. 5 is a flowchart illustrating a print data storage process of the image forming apparatus 100 in the second embodiment. The process illustrated in FIG. 5 is realized by the CPU 112 reading a program stored in the ROM 114 into the RAM 116 and executing the program, for example.

In step S501, the CPU 112 receives print data transmitted from the host computer 200 in step S406 of FIG. 4, and stores the received print data in the storage apparatus 160. In the present embodiment, the print data is explained as something that is stored in the image forming apparatus 100. A configuration may also be taken, however, so as to arrange a server for print data storage (not shown) separately, and to store the print data in the server for print data storage. In step S502, the CPU 112 obtains user information added in the host computer 200 from the print data stored in step S501.

In step S503, the CPU 112 obtains information for identifying print data, such as the print data name or print settings from the print data stored in step S501. In step S504, the CPU 112, based on the user information obtained in step S502, generates a print job list corresponding to the user, registers in the job list a job that is the target of the print, and, after that, finishes the processing of FIG. 5.

In the print job list, information such as the print data name and the print settings obtained in step S503, location information in the storage apparatus 160 of the print data stored in step S501, or the like are described. In the case in which there is already a print job list for the user, the information obtained in step S502 and in step S503 is registered by adding to the print job list in sequence.

Figure 6:
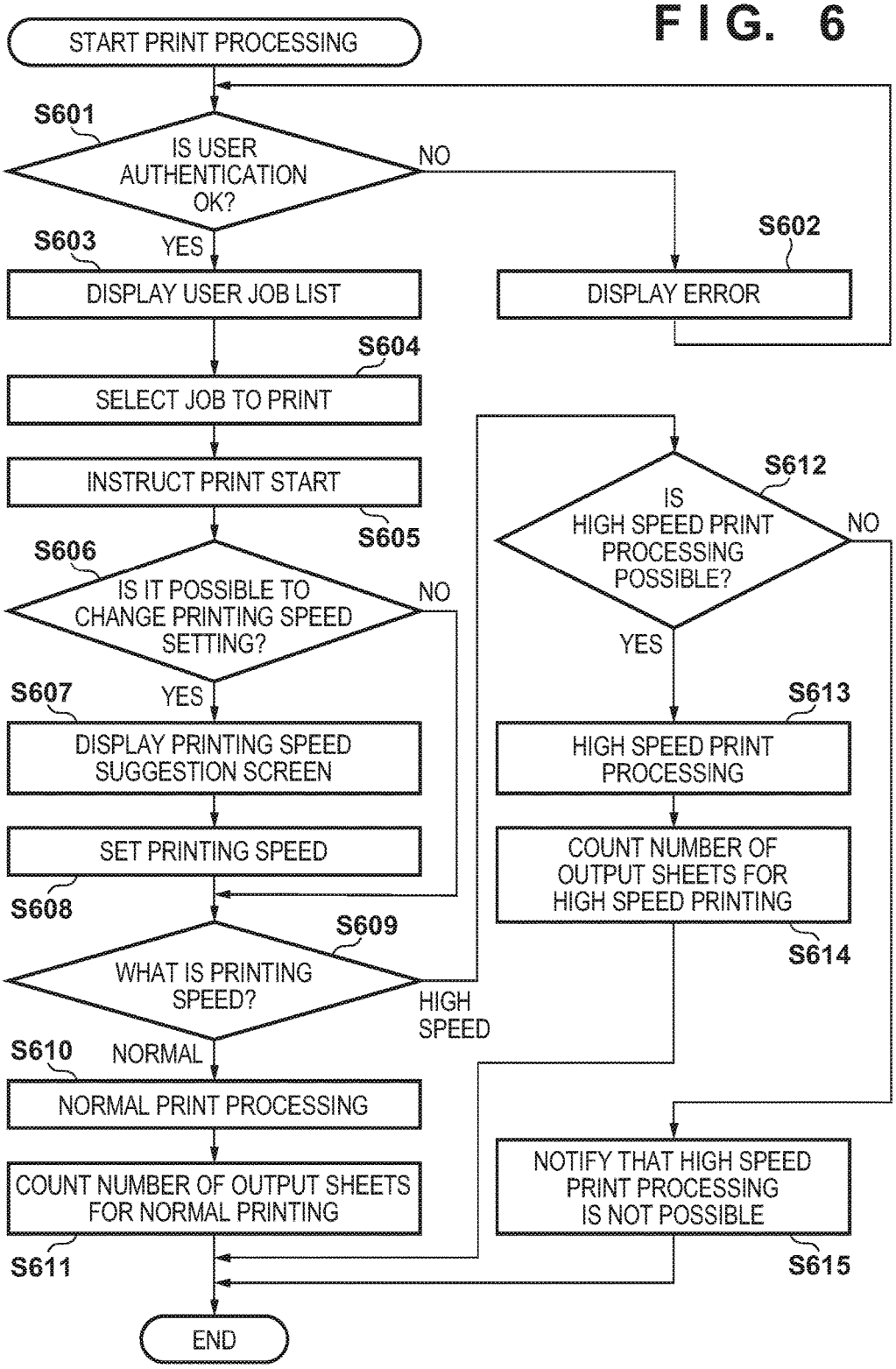
FIG. 6 is a flowchart for describing a printing process of the image forming apparatus.

FIG. 6 is a flowchart illustrating print control processing of the image forming apparatus 100 in the second embodiment. The process illustrated in FIG. 6 is realized by the CPU 112 reading a program stored in the ROM 114 into the RAM 116 and executing the program, for example. When the operating unit 150 receives input of user information on a login screen, the processing of step S601 is started.

In step S601, the CPU 112 receives input of user authentication information from the user by the authentication unit 140, and conveys the inputted user authentication information to the control apparatus 110. The CPU 112 performs verification of the user authentication information against user information that was registered in advance, and determines whether or not to authorize operation of the image forming apparatus 100. The user information that is registered in advance is configured to be saved in the storage apparatus 160 in the image forming apparatus 100. In addition, the foregoing user information that is registered in advance in the external information processing apparatus (not shown) may be saved, and authentication processing of step S601 may be performed in the external information processing apparatus. In the case in which it is determined to authorize operation in step S601, the processing proceeds to step S603, and if it is determined not to authorize operation, the processing proceeds to step S602. In step S602, the CPU 112 performs an error display indicating that the user authentication failed on the display of the operating unit 150. In the case in which the user performs authentication again, the processing returns to step S601, and if not, the processing of FIG. 6 finishes.

Figure 8:
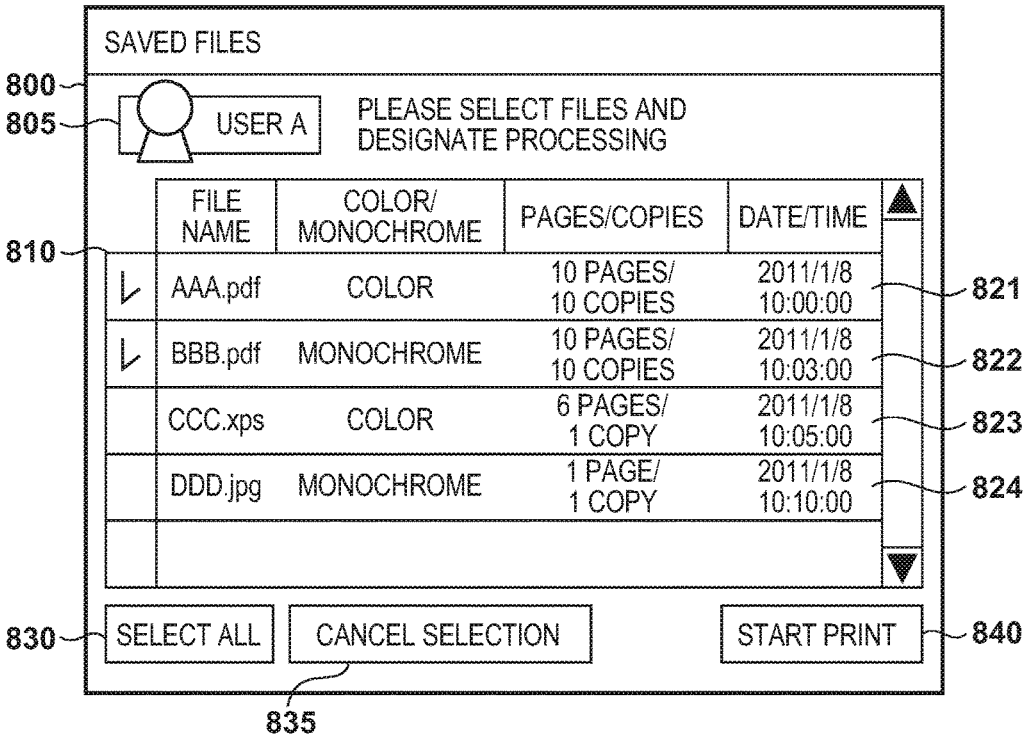
FIG. 8 is a view illustrating a display of a print job list.

In step S603, the CPU 112 displays a print job list corresponding to the authorized user on the operating unit 150. FIG. 8 is a view illustrating an example of a display of a print job list. FIG. 8 is equivalent to the job list generated in step S505 of FIG. 5. A user name 805 of the authorized user is displayed in a print job list 800. A region in which information by which it is possible to identify a print job, such as a file name for the print job, is displayed in the job display regions 821, 822, 823, and 824, and these display regions 821, 822, 823, and 824 have a function of a selection button for selecting the print job. Also, a select-all button 830, a selection cancel button 835, and a print initiation button 840 are displayed.

In step S604, the CPU 112 receives at least one print job selection instruction from among the print job list from the user via the operating unit 150. The user can select a print job by the job display regions 821, 822, 823, and 824, or select all print jobs displayed in the print job list by the select-all button 830. Here, by selecting the selection cancel button 835, the user can cancel the selection of all print jobs selected up until that point. The CPU 112 updates display content of a display of the operating unit 150 so that the user can confirm what is selected by adding a check in a check box 810 of the selected print job. In step S605, the CPU 112, upon a press of the print initiation button 840 from a user via the operating unit 150, receives an instruction to start a printing process (an execution initiation) for a selected print job.

In step S606, the CPU 112 determines whether or not it is possible to change the printing speed setting. The determination processing in step S606 is the same as was described in step S204 of FIG. 2. In the case in which, in step S606, it is determined that the printing speed setting can be changed, the processing proceeds to step S607, and in the case in which it is determined that the printing speed setting cannot be changed, the processing proceeds to step S609.

Figure 9:
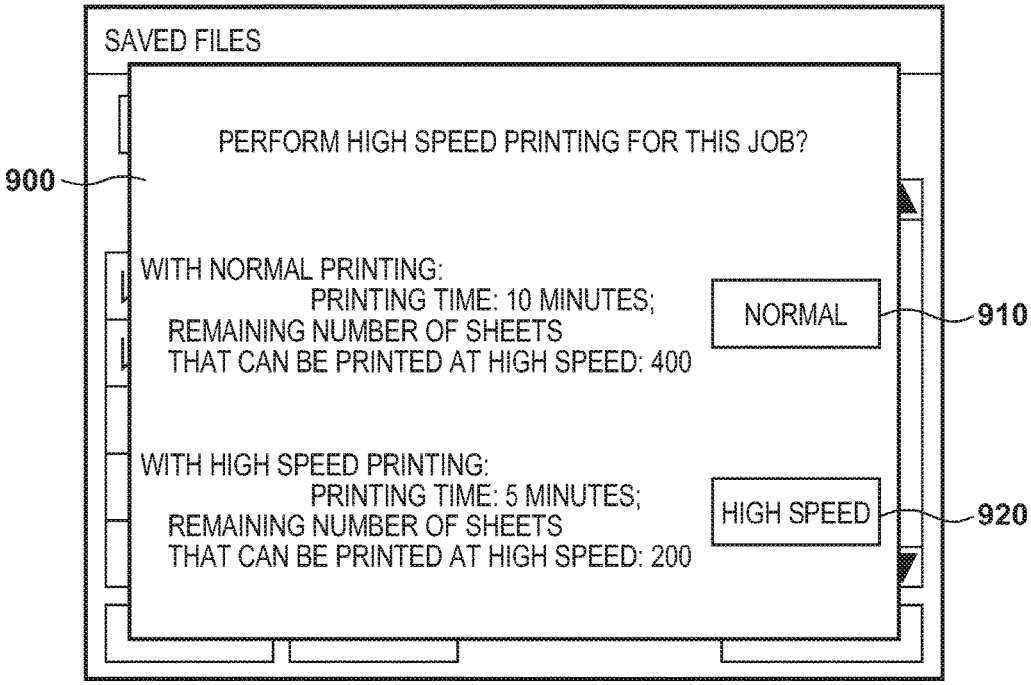
FIG. 9 is a view illustrating a printing speed suggestion screen.

In step S607, the CPU 112 displays a printing speed suggestion screen 900 on the operating unit 150. FIG. 9 is a view illustrating an example of the printing speed suggestion screen. On the printing speed suggestion screen 900, a plurality of printing speed candidates that can be executed in the printing are displayed so as to be selectable. Also, on the printing speed suggestion screen 900, a time required for print processing at each printing speed, and the number of sheets that can be printed at high speed that will remain after print execution are displayed. In the present embodiment, a required amount (required time, required number of sheets, or the like) accompanying a print operation at each printing speed is displayed by displaying the printing speed suggestion screen 900 illustrated in FIG. 9. The result of this is that, in retention printing, the user can determine at which printing speed (normal or high speed) to execute printing considering a prediction value that the print time will be shortened by 5 minutes and the number of sheets that can be printed at high speed will be reduced by 200, for example.

In step S608, the CPU 112 sets the printing speed based on selection information received via the operating unit 150. In a case in which a press of a normal print execution button 910 is received from the user, the CPU 112 sets the normal printing speed as the printing speed for this printing. In a case in which a press of a high speed print execution button 920 is received from the user, the CPU 192 sets the high printing speed as the printing speed for this printing. Specifically, the CPU 112 sets the printing speed that the user designated to the print job that is the target of the printing speed setting. Also, the CPU 112 stores and manages an association of the print job for which the printing speed is set with the set printing speed. Also, as is described later, the print job is executed at the associated printing speed. By this association, even if the user inputs a plurality of print jobs into the image forming apparatus 100, the user can execute each of the print jobs at the printing speeds designated for the respective print jobs. Also, it is possible to designate a printing speed of a target print job independently to a printing speed that another user designated and a printing speed of a currently executing print job.

In step S609, the CPU 112 determines whether the obtained print speed information set in step S608 indicates that the print speed information is the normal printing speed or indicates it is the high printing speed, and switches the following print processing. In the case in which it is determined that the normal printing speed is indicated, the processing proceeds to step S610, and in the case in which it is determined that the high printing speed is indicated, the processing proceeds to step S612.

In step S610, the CPU 112 interprets the print data and generates image data, and transfers print speed information indicating the normal printing speed and the generated image data to the printer apparatus 130. The printer apparatus 130 performs a printing process on a sheet based on the received image data at the normal printing speed. This process is repeated until print processing of all of the print jobs selected in step S604 has finished. In step S611, the CPU 112 increases a counter for normal printing allocated in the RAM 116 or the like by the number of output sheets, and thereafter, the processing of FIG. 6 finishes.

Meanwhile, in step S612, the CPU 112 interprets the print data and generates image data. Also, the CPU 112 determines whether or not high speed print processing is possible based on rendering process (rendering processing) information on the generated image data. That is, when image data having a lot of gradation and thin lines makes high resolution processing necessary, there are cases in which rendering speed cannot keep up with the high printing speed (for example, the rotation speed of the photosensitive drum) that is set. In such a case, it is determined that high speed print processing is not possible, and in step S615, the CPU 112 notifies to the host computer 200 that the high speed print processing is not possible. After that, the processing of FIG. 6 finishes. Meanwhile, based on rendering process information, such as the rendering speed, in a case in which it is determined that high speed print processing is possible, the processing proceeds to step S613. The host computer 200, after receiving the notification from the image forming apparatus 100 in step S615, displays a warning screen that indicates that high speed print processing is not possible on the display unit 220. In this warning screen, it may be possible to receive an instruction to execute printing at the normal printing speed.

In step S613, the CPU 112 transfers the print speed information indicating the high printing speed and the generated image data to the printer apparatus 130. The printer apparatus 130 performs a printing process on a sheet based on the received image data at the high printing speed. This process is repeated until print processing of all of the print jobs selected in step S604 has finished. In step S614, the CPU 112 increases a counter for high speed printing allocated in the RAM 116 or the like by the number of output sheets, and updates the number of sheets that can be printed at high speed that is stored in the storage apparatus 160 and assigned to the user so as to reduce it by the number of output sheets. After that, the processing of FIG. 6 finishes.

In the present embodiment, for all print jobs selected in step S604, the CPU 112 sets the printing speed that the user selected and the printing apparatus 130 performs printing. A configuration may also be taken, however, such that a printing speed setting change is possible for each print job, and a printing speed setting change is made possible for each designated page range, for example, in the middle of a print job. Also, a configuration may also be taken such that, in the present embodiment, in step S607, information of the number of sheets that can be printed at high speed is displayed, and, similarly to the first embodiment, information of an additional amount of money for when high speed printing is performed is displayed.

Third Embodiment

In the first embodiment and in the second embodiment, as in FIG. 7 and FIG. 9, configurations for allowing a user to appropriately determine whether to perform high speed printing or to perform printing at the normal printing speed on all pages that are the job execution target were explained. In the third embodiment, a configuration in which it is not possible to perform high speed printing on all pages that are the job execution target, but it is possible to perform high speed printing on some of the pages, is explained. For example, this corresponds to a case in which the remaining number of sheets that can be printed at high speed and a deposited amount of money corresponding to the user are insufficient to execute high speed printing on all the pages that are the target of job execution, and printing cannot be completed. Hereinafter, description is given regarding points that are different to the previously-described embodiments.

Figure 10:
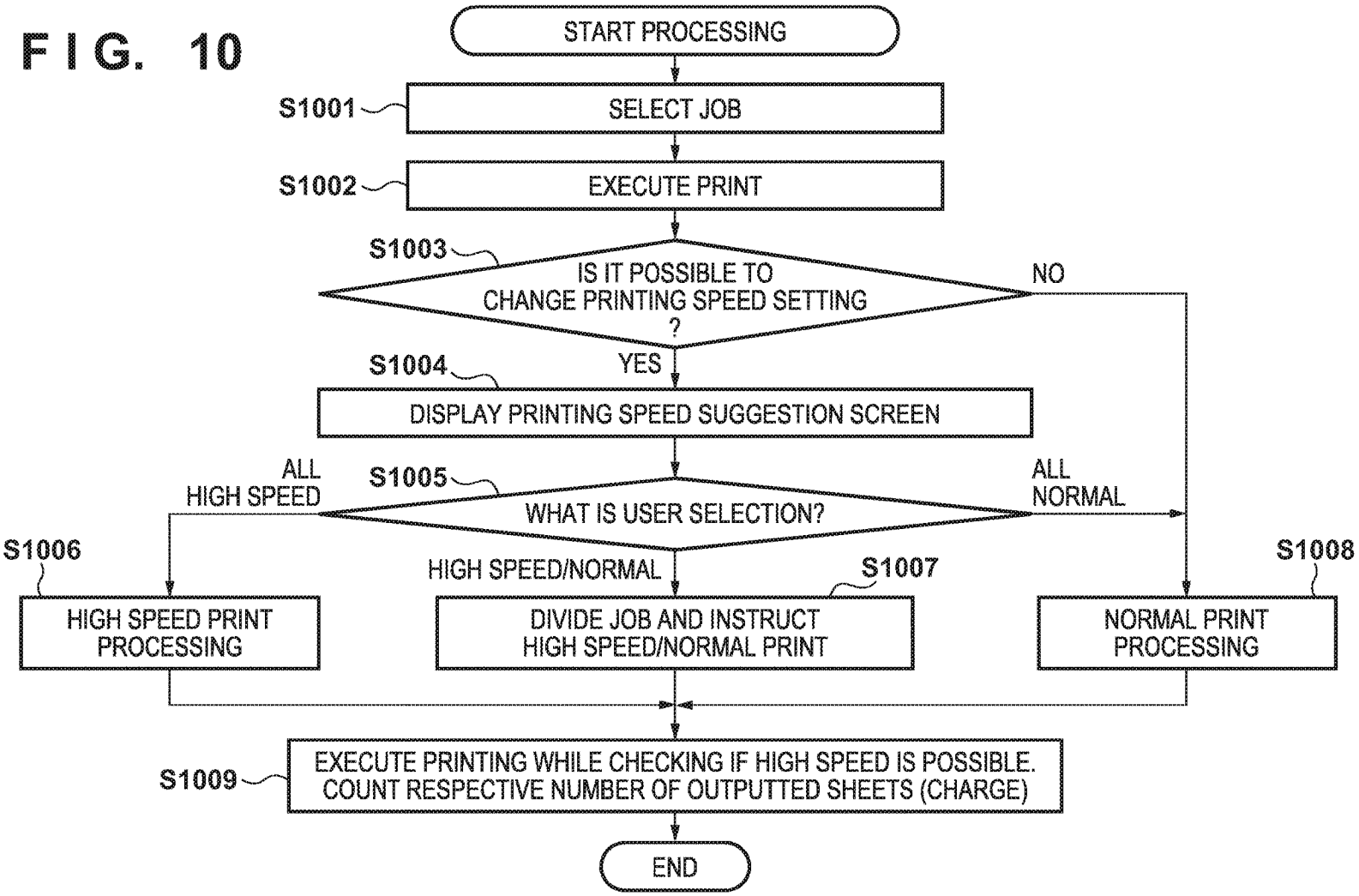
FIG. 10 is a flowchart for describing a printing process of the image forming apparatus.

FIG. 10 is a flowchart illustrating print control processing of the image forming apparatus 100 in the third embodiment. The process illustrated in FIG. 10 is realized by the CPU 112 reading a program stored in the ROM 114 into the RAM 116 and executing the program, for example. In the case of retention printing, as described in the second embodiment, the processing of FIG. 10 is started in a case in which a print job list, as in FIG. 8, is displayed in the image forming apparatus 100.

In step S1001, the CPU 112 receives at least one print job selection instruction from among the print job list from the user via the operating unit 150. In step S1002, the CPU 112, upon a press of the print initiation button 840 from a user via the operating unit 150, receives an instruction to start a printing process for a selected print job.

In step S1003, the CPU 112 determines whether or not it is possible to change the printing speed setting. Here, a determination is performed based on the cost-effectiveness of the case in which high speed printing is executed on all pages. For example, when printing is executed at the high printing speed, the print shortening time is 5 minutes, and the number of sheets that can be printed at high speed becomes 200. Here, assuming that the unit price for a sheet for high speed printing is 0.6 yen, the money amount conversion value is 120 yen, and the shortened time per unit money amount is 2.5 seconds/yen. As cost-effectiveness is high if this value is greater than or equal to the threshold, it is determined in step S1003 that it is possible to change the printing speed setting, and the processing proceeds to step S1004. As cost-effectiveness is low if this value is less than the threshold, it is determined in step S1003 that it is possible to change the printing speed setting, and the processing proceeds to step S1008.

In step S1008, the CPU 112 interprets the print data and generates image data, and transfers print speed information indicating the normal printing speed and the generated image data to the printer apparatus 130. After step S1008, the printer apparatus 130, in step S1009, performs a printing process on a sheet based on the received image data at the normal printing speed. This process is repeated until print processing of all of the print jobs selected in step S1001 has finished. The CPU 112 increases a counter for normal printing allocated in the RAM 116 or the like by the number of output sheets, and thereafter, the processing of FIG. 10 finishes.

Meanwhile, in step S1004, the CPU 112 displays a printing speed suggestion screen 1100 on a display of the operating unit 150. Here, assume that the remaining number of sheets that can be printed at high speed and a deposited amount of money corresponding to the user are insufficient to execute all pages that are the target of job execution.

Figure 11:
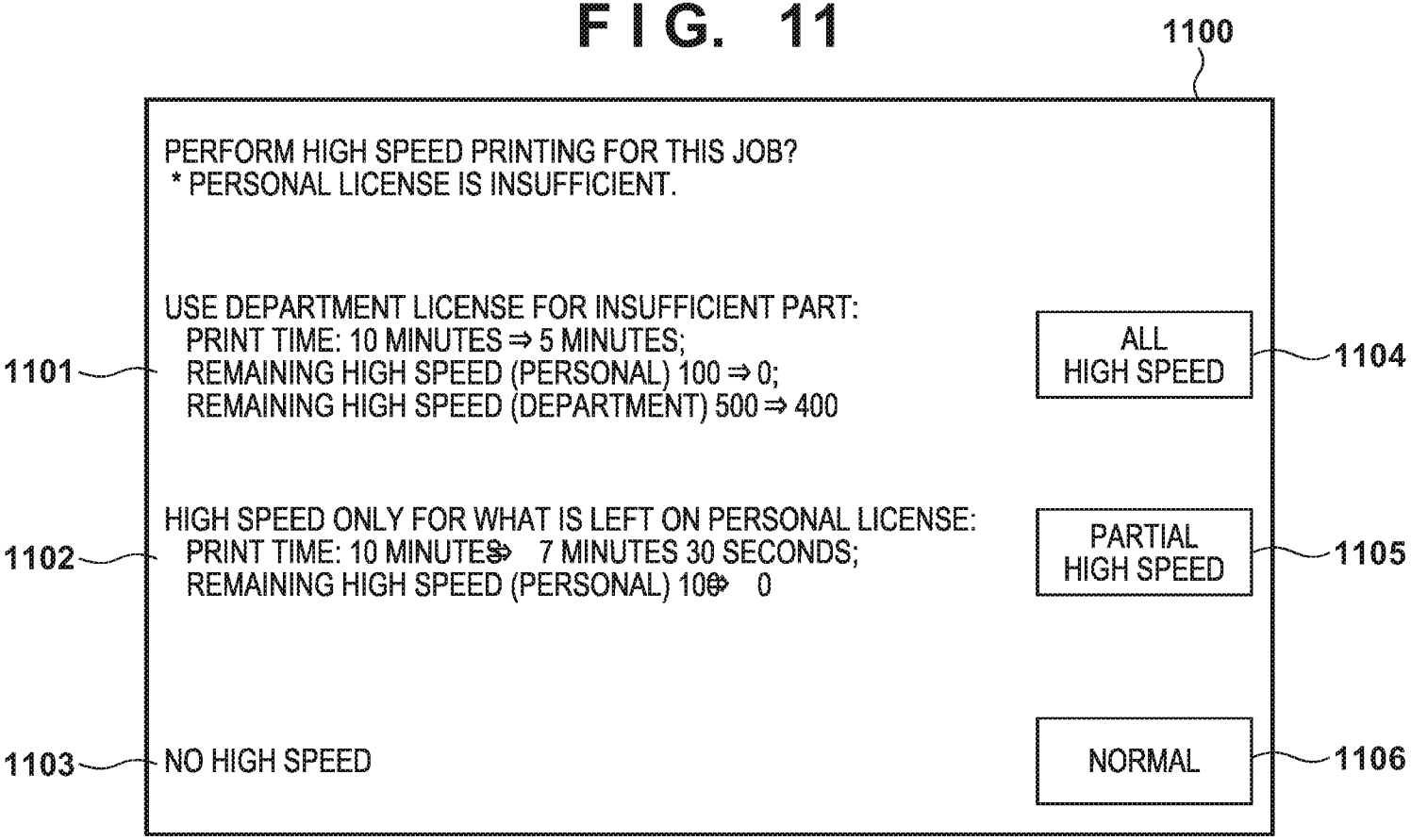
FIG. 11 is a view illustrating a printing speed suggestion screen.

FIG. 11 is a view illustrating an example of the printing speed suggestion screen 1100. On the printing speed suggestion screen 1100, three types of selection items 1101-1103 are displayed. In the present example, the remaining number of sheets that can be printed at high speed by the current user is 100, and the total number of pages that are print job execution targets is 200. The selection item 1101 is for using the user's own remaining 100 sheets that can be printed at high speed, and using sheets from 500 sheets that can be printed at high speed that are assigned as a department license outside of the user's own license for the other 100 sheets. By the screen of FIG. 11, it can be seen that, in the case of this selection item, the print time will be reduced from 10 minutes to 5 minutes, for a 5 minute reduction. Also, after executing printing by this selection item, it can be seen that the remaining number of sheets that can be printed at high speed of the user is 0, and the number of sheets that can be printed at high speed assigned as a department license will be 400.

The selection item 1102 is for using the 100 remaining sheets that can be printed at high speed of the user, and performing printing at the normal printing speed for the remaining 100 sheets. By the screen of FIG. 11, it can be seen that in the case of this selection item, the print time will be reduced from 10 minutes to 7 minutes and 30 seconds, for a 2 minute and 30 second reduction. Also, it can be seen that after executing printing by this selection item, the number of sheets that can be printed at high speed remaining for the user is 0. The selection item 1103 is for not executing high speed printing. That is, all 200 pages that are print job execution targets will be executed at the normal printing speed. In the present example, the print time in this case is 10 minutes.

In step S1005, the CPU 112 determines which selection item is selected on the printing speed suggestion screen 1100. This determination is performed by one of the buttons 1104, 1105, and 1106 being pressed on the printing speed suggestion screen 1100.

In the case that the button 1104 is pressed and it is determined that the selection item 1101 is selected, the processing proceeds to step S1006. In step S1006, the CPU 112 interprets the print data and generates image data, and transfers print speed information indicating the high printing speed and the generated image data to the printer apparatus 130. After step S1006, the printer apparatus 130, in step S1009, performs a printing process on a sheet based on the received image data at the high printing speed. This process is repeated until print processing of all of the print jobs selected in step S1001 has finished. The CPU 112 increases a counter for high speed printing allocated in the RAM 116 or the like by the number of output sheets, and updates the number of sheets that can be printed at high speed that is stored in the storage apparatus 160 and assigned to the user, so as to reduce it by the number of output sheets. Subsequently, the processing of FIG. 10 terminates.

In the case that the button 1105 is pressed and it is determined that the selection item 1102 is selected, the processing proceeds to step S1007. In step S1007, the CPU 112 divides the corresponding print job into a job for the portion of the pages for which printing is executed at the high speed (first job), and a job for the portion of the pages for which printing is executed at the normal printing speed (second job). Also, the CPU 112 transfers print speed information indicating the high printing speed and the image data of the first job part to the printer apparatus 130. Next, the CPU 112 transfers print speed information indicating the normal printing speed and the image data of the second job part to the printer apparatus 130. After step S1007, the printer apparatus 130, in step S1009, performs print processing on sheets based on the image data at each of the printing speeds in the order of reception from the CPU 112, that is, the order of the first job and then the second job. The CPU 112 increases a counter for high speed printing allocated in the RAM 116 or the like by the number of output sheets, and updates the number of sheets that can be printed at high speed that is stored in the storage apparatus 160 and assigned to the user so as to reduce it by the number of output sheets. Also, the CPU 112 increases a counter for normal printing allocated in the RAM 116 or the like by the number of output sheets. Subsequently, the processing of FIG. 10 terminates.

As described above, by virtue of the present embodiment, it is possible to provide a print method in which, even in a case in which the remaining number of sheets that can be printed at high speed and the deposited amount of money of the user are insufficient to execute all pages that are job execution targets, it is possible to use high speed printing. As a result, it is possible for the user to appropriately decide the printing speed while considering the effect of printing by each printing method.

Other Embodiments

Embodiments of the present invention can also be realized by a computer of a system or an apparatus that reads out and executes computer executable instructions (e.g., one or more programs) recorded on a storage medium (that may also be referred to more fully as a 'non-transitory computer-readable storage medium') to perform the functions of one or more of the above-described embodiments and/or that includes one or more circuits (e.g., application specific integrated circuit (ASIC)) for performing the functions of one or more of the above-described embodiments, and by a method performed by the computer of the system or the apparatus by, for example, reading out and executing the computer executable instructions from the storage medium to perform the functions of one or more of the above-described embodiments and/or controlling the one or more circuits to perform the functions of one or more of the above-described embodiments. The computer may comprise one or more processors (e.g., a central processing unit (CPU), or a micro processing unit (MPU)), and may include a network of separate computers or separate processors to read out and to execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), a digital versatile disc (DVD), or a Blu-ray Disc (BD)™) a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A printing system comprising:

(A) a print unit configured to execute printing for a print job at a first printing speed and a second printing speed that is faster than the first printing speed;

(B) a storage unit that stores a number of sheets for which the printing can be executed at the second printing speed;

(C) a display unit that displays a screen in which a user can designate the second printing speed for the print job, and that displays, in the screen in which the user can designate the second printing speed for the print job, a remaining number of sheets for which the printing can be executed at the second printing speed, based on the number of sheets stored in the storage unit;

(D) a control unit that controls the print unit to execute, based on the designation by the user via the screen displayed by the display unit, the printing for the print job at the second printing speed; and (E) an update unit that updates the number of sheets stored in the storage unit by reducing the number of sheets stored in the storage unit by a number of sheets used for the printing at the second printing speed.

2. The printing system according to claim 1, wherein the control unit associates the second printing speed with the print job, and controls the print unit to execute the printing for the print job at the second printing speed.

3. The printing system according to claim 1, wherein the display unit displays the screen in which the user can designate the second printing speed for the print job a print instruction is received from the user.

4. The printing system according to claim 1, wherein the display unit displays, together with the remaining number of sheets for which the printing can be executed at the second printing speed, a time required for the printing at the second printing speed.

5. The printing system according to claim 1, further comprising:

(F) a determination unit that determines whether or not it is possible to execute the printing for the print job at the second printing speed, wherein, if it is determined that it is possible to execute printing at the second printing speed, the display unit displays the screen in which the user can designate the second printing speed for the print job.

6. The printing system according to claim 5, wherein, based on a shortened time, relative to performing the printing at the first printing speed, of performing the printing at the second printing speed and a cost accompanying printing at the second printing speed, the determination unit determines whether or not it is possible to execute printing at the second printing speed.

7. The printing system according to claim 5, wherein the determination unit determines, for the determination, whether or not the user has an authority to utilize the second printing speed.

8. The printing system according to claim 7, wherein the determination unit determines that it is possible to execute printing at the second printing speed based on a condition that the user is determined to have the authority.

9. The printing system according to claim 1, further comprising:

(F) a determination unit that, in a case in which the second printing speed for the print job is designated, determines, based on information of a rendering process on the print job, whether or not it is possible to perform the printing at the second printing speed, wherein, in a case in which the determination unit determines that the printing can be performed at the second printing speed, the control unit controls the print unit to print the print job at the second printing speed.

10. The printing system according to claim 1, wherein the storage unit stores a number of sheets for which printing can be executed at the second printing speed for each user, wherein the printing system further comprises (F) an obtainment unit configured to obtain the number of sheets for which the printing can be executed at the second printing speed assigned to a user that instructed execution of the printing of the print job from the storage unit, and wherein the display unit displays the remaining number of sheets that is obtained from the number of sheets obtained by the obtainment unit and a number of sheets required for printing the print job.

11. The printing system according to claim 1, further comprising (F) a printing apparatus having the print unit and a computer used by the user and having a printer driver of the printing apparatus, wherein the printing apparatus implements the display unit and the control unit.

12. The printing system according to claim 1, further comprising (F) a printing apparatus having the print unit and a computer used by the user and having a printer driver of the printing apparatus, wherein the printing apparatus implements the control unit, and the computer implements the display unit.

13. The printing system according to claim 1, wherein the print unit changes a printing speed from one of the first printing speed and the second printing speed to another one of the first printing speed and the second printing speed by changing a sheet feeding interval.

14. The printing system according to claim 1, wherein the screen in which the user can designate the second printing speed for the print job is a screen for allowing the user to select either the first printing speed or the second printing speed as a selected printing speed, and wherein the control unit controls the print unit to execute, based on the selection by the user via the screen, the printing for the print job at the selected printing speed.

15. The printing system according to claim 1, wherein the display unit displays, for comparison, a remaining number of sheets for which the printing can be executed at the second printing speed when the print job is printed at the first printing speed, and a remaining number of sheets for which the printing can be executed at the second printing speed when the print job is printed at the second printing speed.

16. The printing system according to claim 15, wherein the display unit displays, for comparison, a time required for the printing at the first printing speed and a time required for the printing at the second printing speed.

17. A printing system comprising:

(A) a print unit configured to execute printing for a print job at a first printing speed and a second printing speed that is faster than the first printing speed;

(B) a storage unit that stores a number of sheets for which the printing can be executed at the second printing speed;

(C) a display unit that displays a plurality of candidates of printing speeds for the print job so as to be selectable by a user; and (D) a control unit that controls the print unit to execute, based on a selection by the user, the printing for the print job at a printing speed selected by the user from the displayed plurality of printing speed candidates, wherein, in a case in which it is not possible, using a license of the user that instructed execution of the printing of the print job, to complete the printing of the print job at the second printing speed, the display unit displays so that it is possible to select:

(a) to perform the printing of the print job at the second printing speed by using a license other than the license of the user;

(b) to perform the printing of a part of the print job that can be printed by the license of the user at the second printing speed, and to perform printing of a remaining part of the print job at the first printing speed; or (c) to perform the printing of the print job at the first printing speed.

18. A printing method of printing a print job at a first printing speed and a second printing speed that is faster than the first printing speed, the printing method comprising:

storing, in a storage unit, a number of sheets for which the printing can be executed at the second printing speed;

displaying, in a display unit, a screen in which a user can designate the second printing speed for the print job;

displaying, in the screen in which the user can designate the second printing speed for the print job, a remaining number of sheets for which the printing can be executed at the second printing speed, based on the number of sheets stored in the storage unit;

executing, based on the designation by the user via the screen displayed in the display unit, the printing for the print job at the second printing speed; and updating the number of sheets stored in the storage unit by reducing the number of sheets stored in the storage unit by a number of sheets used for the printing at the second printing speed.

* * * * *